US007517309B2

(12) United States Patent
De Matteis

(10) Patent No.: US 7,517,309 B2
(45) Date of Patent: Apr. 14, 2009

(54) STRUCTURE OF INTERFOLDING MACHINE

(75) Inventor: Alessandro De Matteis, Lucca (IT)

(73) Assignee: MTC-Macchine Trasformazione Carta S.R.L., Pocari, Lucca (IT)

( * ) Notice: Subject to any disclaimer, the term of this patent is extended or adjusted under 35 U.S.C. 154(b) by 0 days.

(21) Appl. No.: 11/215,440

(22) Filed: Aug. 30, 2005

(65) Prior Publication Data

US 2006/0052228 A1 Mar. 9, 2006

(30) Foreign Application Priority Data

Aug. 31, 2004 (EP) ..... 04425654

(51) Int. Cl.
*B31B 1/26* (2006.01)

(52) U.S. Cl. ..... 493/477; 493/411; 493/430; 493/448

(58) Field of Classification Search ..... 493/411, 493/413, 430, 433, 448, 471, 473, 475, 477, 493/478
See application file for complete search history.

(56) References Cited

U.S. PATENT DOCUMENTS

| | | | | |
|---|---|---|---|---|
| 4,861,326 | A | 8/1989 | Kuhner et al. | 493/359 |
| 4,917,665 | A * | 4/1990 | Couturier | 493/472 |
| 5,088,707 | A | 2/1992 | Stemmler | 270/39 |
| 5,310,398 | A * | 5/1994 | Yoneyama | 493/430 |
| 5,394,975 | A * | 3/1995 | Bernhard | 198/473.1 |
| 6,213,927 | B1 * | 4/2001 | De Matteis et al. | 493/360 |
| 6,228,014 | B1 * | 5/2001 | De Matteis et al. | 493/424 |
| 6,666,803 | B1 * | 12/2003 | Spatafora | 483/16 |
| 6,675,555 | B1 * | 1/2004 | Monti | 53/167 |
| 6,852,073 | B2 * | 2/2005 | Neumann et al. | 493/435 |
| 7,060,016 | B2 * | 6/2006 | Cipolli | 493/478 |
| 7,146,777 | B2 * | 12/2006 | Focke et al. | 53/52 |
| 2004/0126172 | A1 | 7/2004 | Matteis | 400/578 |

FOREIGN PATENT DOCUMENTS

| | | |
|---|---|---|
| DE | 43 32 792 | 3/1995 |
| EP | 0 380 064 | 8/1990 |
| EP | 1 415 945 | 5/2004 |
| WO | WO 03/082675 | 10/2003 |

* cited by examiner

*Primary Examiner*—Hemant M Desai
(74) *Attorney, Agent, or Firm*—Dennison, Schultz & MacDonald

(57) ABSTRACT

An interfolding machine having a framework (1) comprising a first plate (20*a*) and a second plate (20*b*), parallel to each other, interconnected by means of beams (15, 25, 26). Each plate (20*a* or 20*b*), has a modular structure and comprises at least one lower portion (22*a* or 22*b*) and an upper portion (23*a* or 23*b*). The upper portions (23*a*, 23*b*) of the plates (20*a*, 20*b*) are connected by beams (25), whereas the lower portions (22*a*, 22*b*) are connected by relative beams (26, 15). The upper portion has a portion (5) removable independently from the framework (1). The removable portion (5) comprises cutting rollers (8), the rollers bringing a cutting tool (10) and folding rollers (9). The web conveying rollers (6, 7), conveying the paper along the direction of process are mounted on the fixed portion (24) of the upper portion (23) of the framework (1).

8 Claims, 3 Drawing Sheets

Fig. 1
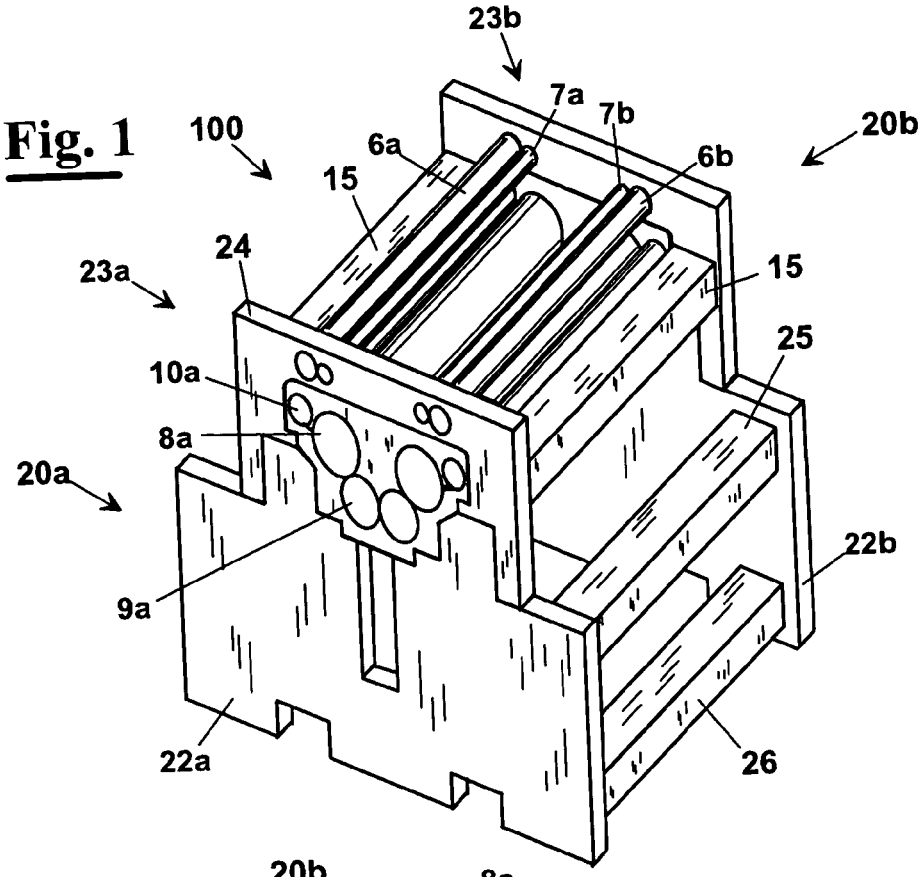
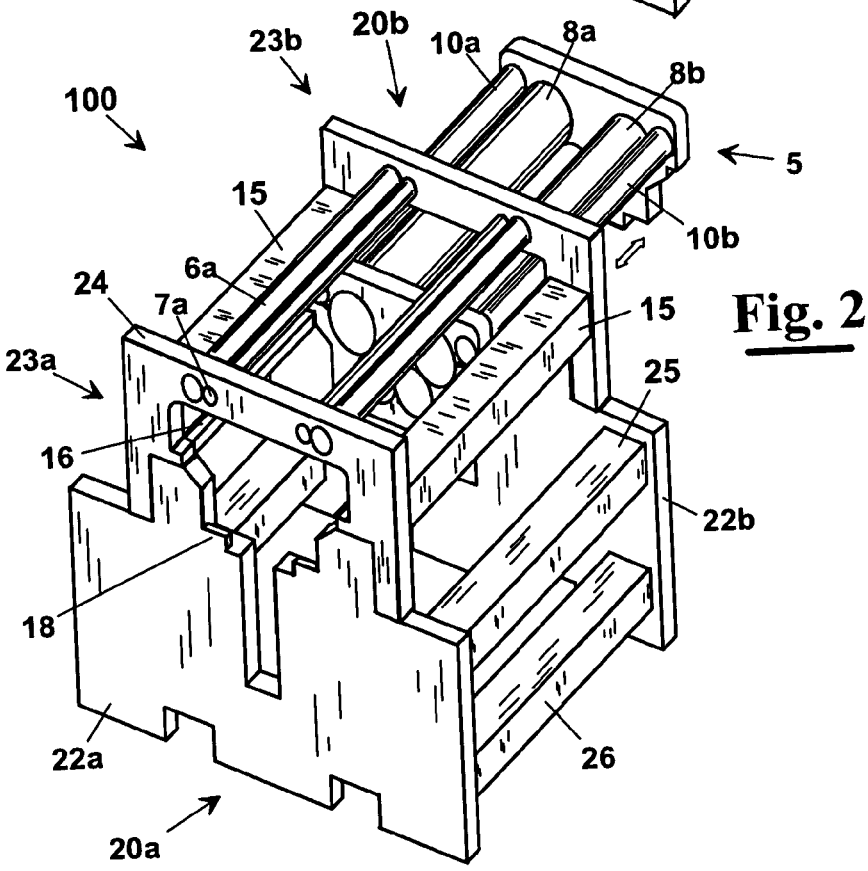
Fig. 2

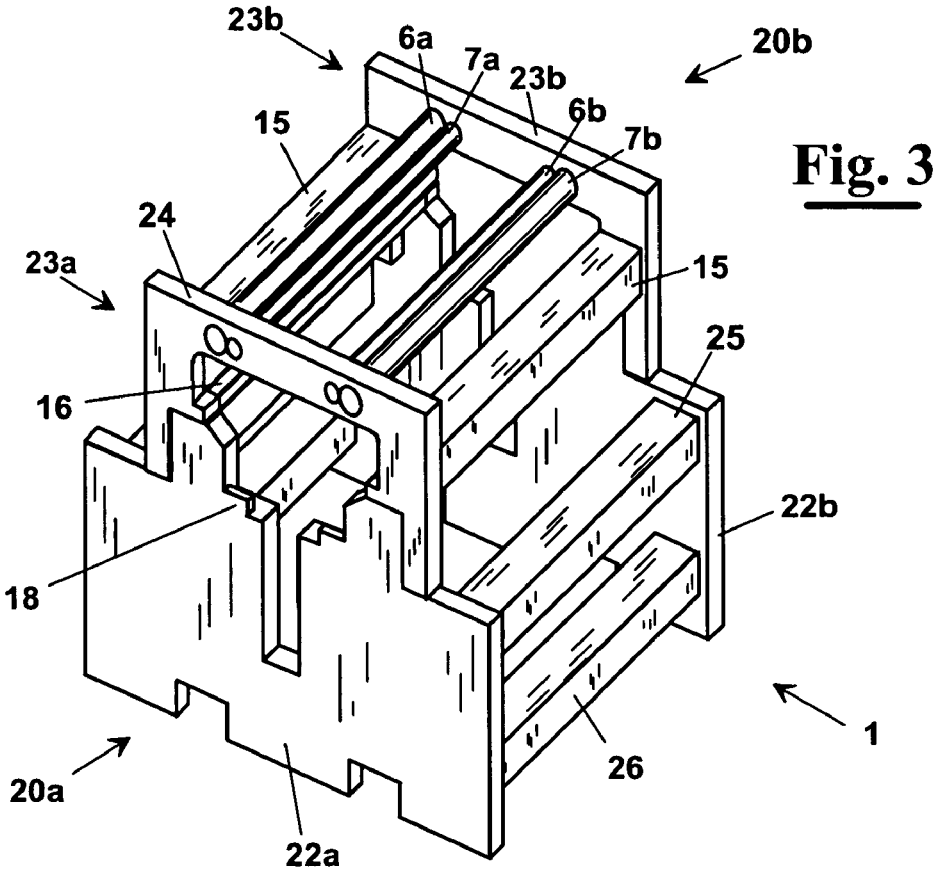
Fig. 3
Fig. 4
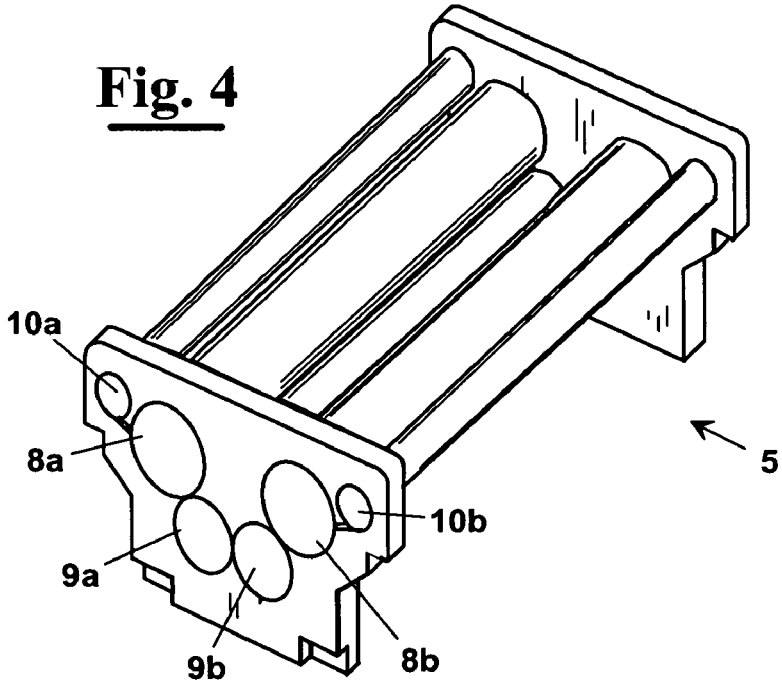

STRUCTURE OF INTERFOLDING MACHINE

CROSS REFERENCE TO RELATED APPLICATIONS

This application claims priority of European Patent Application No. 04425654.3, filed Aug. 31, 2004, which application is incorporated herein by reference.

FIELD OF THE INVENTION

The present invention relates to the production of paper material in stacks of interfolded sheets and in particular it relates to a structure of an interfolding machine capable of processing sheets of different length.

BACKGROUND OF THE INVENTION

As is well known, in the industry of paper a variety of types of machines and of processes exist for making paper tissues, paper towels and the like by producing stacks of interfolded sheets of a certain height.

They are obtained by folding the sheets in an "interfolded" way, namely folding into panels by overlapping at the same time a panel of a previous sheet with a panel of a following sheet. In this way, when pulling a sheet from the stack, at the moment of the use also a panel of the following sheet is pulled out, with consequent advantages for certain types of uses. Among the possible interfolding ways, stacks of L, Z or W interfolded sheets are known having 2, 3 and 4 panels, respectively.

Machines are known that use one or more webs of paper, coming from one or more reels, that are cut into sheets and then supplied offset with respect to one another on folding counter-rotating rollers.

More precisely, the webs are cut into sheets by means of cutting rollers that engage with respective blades. In the case of L or W interfolding, the webs are cut so that they form a sequence of offset sheets coming preferably from two different directions. Therefore, the sheets coming from both directions are supplied alternately to the folding rollers so that each sheet coming from a first direction overlaps a portion of a sheet coming from the second direction, and vice versa.

The sheets coming from either directions, in order to be overlapped in the above described way, adhere to the respective folding rollers by means of a vacuum-suction step or by means of a mechanical gripping. Therefore, the downstream portion of each sheet leaves its folding roller at the point of contact between the two rollers, then adhering to the other folding roller, to which the upstream portion of the previous sheet has adhered.

The method for Z interfolding is similar as above described, with the difference being that the overlap between two consecutive sheets occurs just after the cutting step and a sequence of overlapping and offset sheets come to the folding rollers from only one direction.

The interfolded stacking step is accomplished with the aid of folding elements, which in the case of rollers with mechanical folding means, consist of mechanical clamps incorporated in the roller. In case instead of folding rollers with suction system the folding elements consist of folding arms that have an oscillating motion about a pivot and that separate in turn from the respective roller the upstream portion of each sheet joined to the overlapped downstream portion of the following sheet. The folding arms are normally arranged in two rows and operate alternatively with the paired portions of sheets, which adhere to the first or to the second folding roller.

The folding rollers with suction folding means have a plurality of circumferential grooves, into which the ends of said folding arms go without blocking their rotation. At the passage of two overlapped portions of two consecutive sheets, that adhere to a roller and cover an end of the folding arms, the folding arms rotate so that their ends go out the grooves and push the two overlapped portions away from the folding roller, thus folding them onto previously interfolded sheets stacked below.

The folding rollers have a circumference that is normally multiple of the length of the sheets. Therefore, a sheet is added to the stack of interfolded sheets at each respective fraction of turn of the folding rollers.

Downstream from the rollers above described, along the direction of process, a plurality of means for separation is furthermore provided that enters the stack for all or part of its width. This way, a package is separated from a next one, and precisely the packages of a predetermined height are put in turn on a support table that eventually loads them on a conveyor and then moves back for receiving another pack.

As said above, in the interfolding machines the length of the interfolded sheets that form the stack of final product is due to the circumference of the cutting rollers and to the angular distance at which the cutting means are arranged. In other words, the length of cut is fixed and is measured univocally by the circumference of the rollers. In particular, both the folding rollers and the cutting rollers have a circumference multiple to the length of the sheets. For this reason each interfolding machine causes the production of interfolded sheets of a single length, whereby the production process is not flexible. For sheets of different length it is therefore necessary to provide different machines.

SUMMARY OF THE INVENTION

It is therefore a feature of the present invention to provide a structure of an interfolding machine that provides stacks of interfolded sheets of different length easily and cheaply causing the whole production process to be flexible, allowing different products to exit from a same machine.

This and other objects are accomplished by the structure of an interfolding machine, according to the present invention, having a framework comprising:

- a feeding section where at least one web of paper is fed;
- an interfolding section comprising:
  - cutting rollers on which knives are arranged suitable for dividing the web of paper into sheets of predetermined length;
  - folding rollers to which the above described sheets adhere in order to be overlapped in a determined configuration;
  - folding elements associated to said folding rollers that arrange the sheets in a determined interfolded configuration forming underneath a stack of product; and,
- a separating section where a pack of interfolded sheets is separated from the following and withdrawn from the area of process through separating means;
- whose main feature is that said interfolding section comprises a portion having a modular structure removable independently from said framework, said portion comprising at least said folding rollers and being replaceable with an equivalent portion.

In this way, with a single interfolding machine having more removable portions each with rollers of different diameter it is possible to provide stacks of interfolded sheets of different length so that the machine is highly flexible.

Advantageously, the removable portions, each with rollers of different diameter, are mounted on a automatic introduction/extracting machine, for example a carousel having a horizontal axis, capable of receiving more removable portions and selectively extracting/inserting a portion at a time from/in the interfolding machine.

In particular, the folding arms and the relative handling mechanisms are connected to a portion independent from the removable portion.

The removable portion can comprise in addition to the folding rollers also the cutting rollers and also web conveying rollers.

In particular, the removable portion can be arranged slidingly mounted on guides provided longitudinally with respect to the framework.

Advantageously, the separating means suitable for entering the stack for separating a pack from a next one being formed, as well as vertical guides containing the stack, are mounted on carriages that can be approached to/moved away from each other along a direction transversal to said framework for bringing them at an operative distance correlated to the size of the rollers mounted on said machine.

The removable portion of the interfolding machine comprises two plates, or side shoulders, parallel and interconnected by means of transversal beams parallel to the folding roller, which are elements of the machine.

Also the framework of the interfolding machine comprises two side shoulders, each consisting of one or more parallel plates interconnected by means of transversal beams, to which the remainder elements of the machine are connected, at least one of said side shoulders having an opening for introducing the removable portion.

BRIEF DESCRIPTION OF THE DRAWINGS

Further characteristics and the advantages of the interfolding machine, according to the invention, will be made clearer with the following description of an exemplary embodiment thereof, exemplifying but not limitative, with reference to the attached drawings, in which like reference characters designate the same or similar parts, throughout the figures of which:

FIG. 1 shows diagrammatically a perspective view of an interfolding machine, according to the invention;

FIG. 2 shows a perspective view of the interfolding machine of FIG. 1 with the removable portion in a position of being moved away from the working position;

FIG. 3 shows a perspective view of the interfolding machine of FIG. 1 without the removable portion ready for receiving a removable portion with different features;

FIG. 4 shows in detail a perspective view of the removable portion; and,

DETAILED DESCRIPTION OF THE INVENTION

Figure 5:
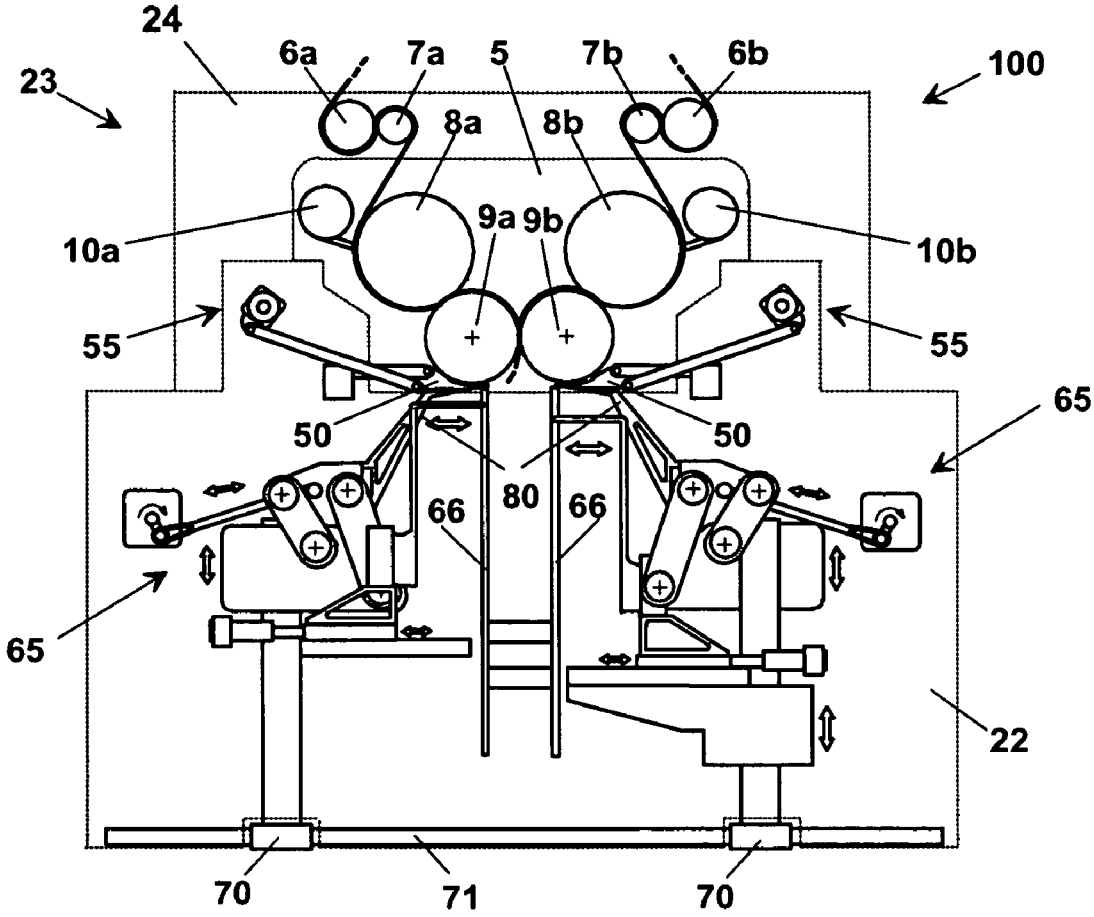
FIG. 5 shows diagrammatically an elevational front view of the positions of the different structural elements with respect to the different sections of the interfolding machine of FIG. 1.

With reference to FIG. 1, an interfolding machine, according to the present invention, has a modular structure. In particular, the interfolding machine 100 provides a framework 1 (visible alone in FIG. 3) comprising a first plate 20*a* and a second plate 20*b*, parallel to it, interconnected by means of beams 15, 25 and 26. More in detail, each plate 20*a*, or 20*b*, has a modular structure and comprises at least one lower portion 22*a*, or 22*b*, and an upper portion 23*a*, or 23*b*. The upper portions 23*a* and 23*b* of the plates 20*a* and 20*b* in FIGS. from 1 to 3 are connected by beams 25, whereas the lower portions 22*a* and 22*b* are connected by beams 26 and 15.

In particular, the upper portion has a portion 5 removable independently from the framework 1. More in detail, the removable portion 5, as in the case shown in FIGS. from 1 to 5, comprises the cutting rollers 8, the relative rollers that bring the cutting tool 10 and the folding rollers 9. Whereas the web conveying rollers 6 and 7 which pull the paper along the direction of process are mounted on the fixed portion 24 of the upper portion 23 of the framework 1.

Obviously, in the extent of the present invention, the removable portion 5 can comprise, in a way not shown, only folding rollers 9*a* and 9*b*.

The removable portion 5 can be arranged slidingly mounted on a longitudinal guide 16 (FIG. 2). In the embodiment illustrated in the figures a stopping element 18 is provided. In particular, the stopping element 18 is suitable for stopping the sliding of the removable portion 5 when it reaches the correct position.

This assists both the removal of the portion from the working position (FIG. 1) and the change with another removable portion provided with rollers of diameter corresponding to the desired length of the interfolded sheets of the stack. As said above, in fact, the length of the interfolded sheets of the stack of the final product is related to the circumference of the folding rollers 9 and of the cutting rollers 8. The modular structure, in the way above described for the interfolding machine, allows to replace quickly the rollers and then to change the kind of the final product.

To carry out easily the operations above described the folding arms 50, which bring the sheets in a determined interfolded configuration making a stack of the product, as well as the respective handling mechanisms 55, are arranged according to a position of not interferencing when placing the removable portion 5. More in detail, as shown in FIG. 5, the folding arms 50 and the respective handling mechanisms 55 are connected to the portion 22 independent from the removable portion 5.

Furthermore, the separating means 60, the possible sheet stretchers 80 and the respective handling mechanisms 65, as well as the vertical guides 66, are mounted on carriages 70 sliding horizontally along a guide 71 in order to bring them at a corresponding distance fitting the configuration working measured by the circumference of the folding rollers 9 and of the cutting rollers 8 mounted on the machine.

In a way not shown in the figures, the removable portions, each with rollers of different diameter, are mounted on an automatic introduction/extracting machine, of easy construction by a skilled person, for example a carousel having horizontal axis, capable of receiving more removable portions and selectively extracting/inserting a portion at a time from/in the interfolding machine.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realize the different functions described herein could have a different nature without, for this reason, departing from the field of the invention. It is to be understood that the phraseology or terminology employed herein is for the purpose of description and not of limitation.

What is claimed is:

1. An interfolding machine assembly comprising:

a framework having a first plate and a second plate parallel to each other and interconnected by transversal beams, each plate comprising at least one lower part and one upper part, each upper part receiving one of a plurality of removable portions, each one of said plurality of removable portions including:

a feeding section arranged between the upper parts of said plates and where at least one web of paper is fed;

cutting rollers arranged between the upper parts of said plates on which knives are arranged suitable for dividing the web of paper into sheets of predetermined length;

an interfolding section arranged between said upper parts of said plates and comprising:

two folding rollers to which the above described sheets adhere in order to be overlapped in a determined configuration;

folding elements associated to said folding rollers that arrange the sheets in a determined interfolded configuration forming underneath a stack of product, wherein said sheets are folded according to a succession of panels of predetermined length; and;

a separating section, arranged between said lower parts of said plates where a pack of interfolded sheets is separated from a following pack and withdrawn from the area of process through separating means;

wherein each one of said plurality of removable portions of the upper parts of said plates are removable independently from a remainder of said framework support at least said folding rollers, and wherein the two removable portions interconnected by said transversal beams and by at least said two folding rollers form a modular portion, said modular portion being removable integrally and replaceable with at least one equivalent removable modular portion, wherein said folding rollers of said modular portion and said equivalent modular portion each have a circumference that is a multiple of a predetermined panel length.

2. The interfolding machine, according to claim 1, wherein an automatic introduction/extracting machine is provided for said removable portions, said automatic introduction/extracting machine being capable of housing several among said modular portions and of extracting/inserting selectively one of said modular portions at a time from/in the interfolding machine.

3. The interfolding machine, according to claim 1, wherein said folding elements, which are comprised of relative handling mechanisms, are connected to a portion independent from removable portion.

4. The interfolding machine, according to claim 1, wherein said removable portion comprises in addition to said folding rollers also said cutting rollers.

5. The interfolding machine, according to claim 1, wherein said removable portion comprises in addition to said folding rollers, said cutting rollers and web conveying rollers.

6. The interfolding machine, according to claim 1, wherein said removable portion comprises in addition to said folding rollers, also said folding elements.

7. The interfolding machine, according to claim 1, wherein said removable portion is slidingly mounted on guides provided longitudinally with respect to said framework.

8. The interfolding machine according to claim 1, wherein said separating means suitable for entering the stack for separating a pack from a next one being formed, as well as vertical guides containing the stack, are mounted on carriages that can move towards/away from each other along a direction transversal to said framework for bringing them at an operative distance correlated to the size of the rollers mounted on said machine.

* * * * *